US006154901A

United States Patent [19]

Carr

[11] Patent Number: 6,154,901

[45] Date of Patent: Dec. 5, 2000

[54] SPINAL-SURGERY TABLE

[75] Inventor: James Carr, Cos Cob, Conn.

[73] Assignee: New York Society for the Relief of the Ruptured and Crippled Maintaining the Hospital for Special Surgery, New York, N.Y.

[21] Appl. No.: 09/161,005

[22] Filed: Sep. 25, 1998

Related U.S. Application Data

[60] Provisional application No. 60/060,191, Sep. 26, 1997.

[51] Int. Cl.[7] ..... A47B 7/00

[52] U.S. Cl. ..... 5/621; 5/630; 5/601; 5/632

[58] Field of Search ..... 5/621, 600, 601, 5/630, 632, 612, 652, 657, 943

[56] References Cited

U.S. PATENT DOCUMENTS

| | | | |
|---|---|---|---|
| 5,131,106 | 7/1992 | Jackson | 5/607 X |
| 5,163,193 | 11/1992 | Whitmore | 5/652 X |
| 5,390,383 | 2/1995 | Carn | 5/621 X |
| 5,575,027 | 11/1996 | Mueller | 5/621 |

*Primary Examiner*—Lynne H. Browne
*Assistant Examiner*—Fredrick Conley
*Attorney, Agent, or Firm*—Darby & Darby

[57] ABSTRACT

A patient support device for supporting a patient at four points during back-related surgery. The device includes a generally rectangular frame having two opposing end members and two opposing side members. Two front posts are slidably mounted to one of the two end members. A travelling member is slidably mounted to both side members and may be displaced in a longitudinal direction between the two end members. Two rear posts are slidably mounted to the travelling member and may be displaced therealong, in a transverse direction between the side members. A front lead screw assembly is connected to the two front posts and allows simultaneous and opposing displacement of both front posts along the end member so that both front posts may be moved an equal distance from a center axis. Similarly, a rear lead screw assembly is connected to the two rear posts to allow simultaneous and opposing displacement of both rear posts along the travelling member. Each post includes a U-shaped channel to collectively accommodate a film cassette used in radiography. A conforming cushion is positioned above each post for contacting the patient.

5 Claims, 5 Drawing Sheets

SPINAL-SURGERY TABLE

Continuation of Provisional Application Ser. No. 60/060, 191, Sep. 26, 1997.

BACKGROUND OF THE INVENTION a) Field of the Invention

This invention generally relates to devices for supporting patients during surgery, in particular four-post supporting tables used to support a patient in an appropriate prone position during spinal surgery.

b) Description of the Prior Art

Positioning of a patient is an important consideration in any back-related back surgery. In general, a patient must be positioned in a prone position to provide the surgeon adequate access to the surgical site. Early in the history of back-related surgical procedures, patients were simply positioned on their stomachs on an operating table or bed mattress. Although this supporting technique afforded the surgeon with sufficient access to the areas of the patient's back, it suffered drawbacks.

Modem back-related surgical procedures typically include X-ray imaging during the surgery. X-ray imaging requires that a film cassette be positioned so that the patient resides between the film cassette and an X-ray emitter. Positioning X-ray cassettes under a patient laying on their stomach is a difficult task and could easily cause injury to the patient, especially during surgery.

Back surgery is often accompanied by substantial blood loss. If has been found that placing a patient on their stomach directly on a table or other surface increases the intra-abdominal pressure which tends to accelerate blood loss. Blood loss may be reduced by supporting the patient in a prone position with the abdomen suspended and free. With this principal in mind, structures were developed which would suspend a patient in such a prone position over the operating table.

Typically, a patient is supported in a prone position by two sets of opposed pads arranged in V-shaped pairs and connected by a surrounding framework. One pair of opposed pads supports the lateral aspects of the upper thoracic cage and the other pair supports the antero-lateral aspects of the pelvic girdle. This structure supports a patient above the operating table and reduces intra-abdominal pressure by allowing the abdomen to hang pendulous and free. Although such support structures help reduce blood loss, they limit the ability of the surgeon to adjust the position of the patient during surgery. During back-related surgery, it is typically desirable to raise and lower the patient, to raise one end of the patient relative to the other, and to tilt the patient's back towards or away from the surgeon along an axis running generally through the spine, that is to rotate the patient from side to side. The existing support structures which support a patient in a prone position with the abdomen pendulous and free are not adapted to allow such manipulations by the surgeon.

It is therefore an object of the invention to provide a patient support device that overcomes the deficiencies of the prior art.

It is another object of the invention to provide a patient support device that is portable and readily attachable to operating tables.

It is another object of the invention to provide a patient support device that is easy to manufacture, modify and operate.

It is yet another object of the invention to provide a patient support device that allows an operator to easily and simultaneously adjust a pair of support cushions apart from each other and equidistant from the spine of a patient.

It is yet another object of the invention to provide a patient support device that provides easy and immediate access to film cassettes used in radiography.

SUMMARY OF THE INVENTION

A patient support device for supporting a patient at four points during back-related surgery. The device includes a generally rectangular frame having two opposing end members and two opposing side members. Two front posts are slidably mounted to one of the two end members. A travelling member is slidably mounted to both side members and may be displaced in a longitudinal direction between the two end members. Two rear posts are slidably mounted to the travelling member and may be displaced therealong, in a transverse direction between the side members. A front lead screw assembly is connected to the two front posts and allows simultaneous and opposing displacement of both front posts along the end member so that both front posts may be moved an equal distance from a center axis. Similarly, a rear lead screw assembly is connected to the two rear posts to allow simultaneous and opposing displacement of both rear posts along the travelling member. Each post includes a U-shaped channel to collectively accommodate a film cassette used in radiography. A conforming cushion is positioned above each post for contacting the patient.

DETAILED DESCRIPTION OF THE PREFERRED EMBODIMENTS

The purpose of the present invention is to provide a simple device for supporting a patient's torso over an operating table at four independent points; approximately two inches below the right and left axillary fossa, and at the right and left anterior superior iliao spine.

Figure 1:
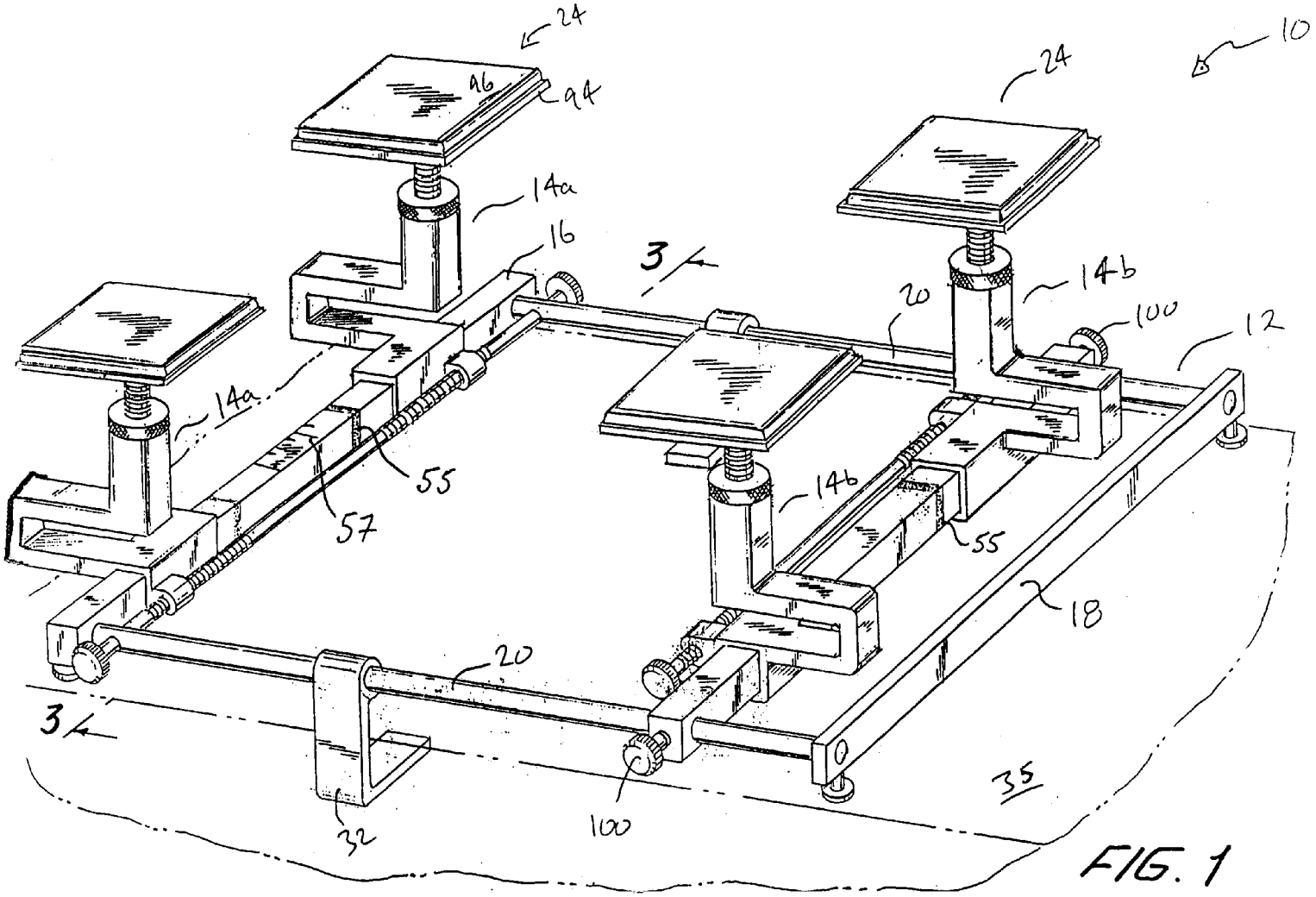
FIG. 1 is a perspective view of a patient support device, in accordance with a first embodiment of the invention.
Figure 2:
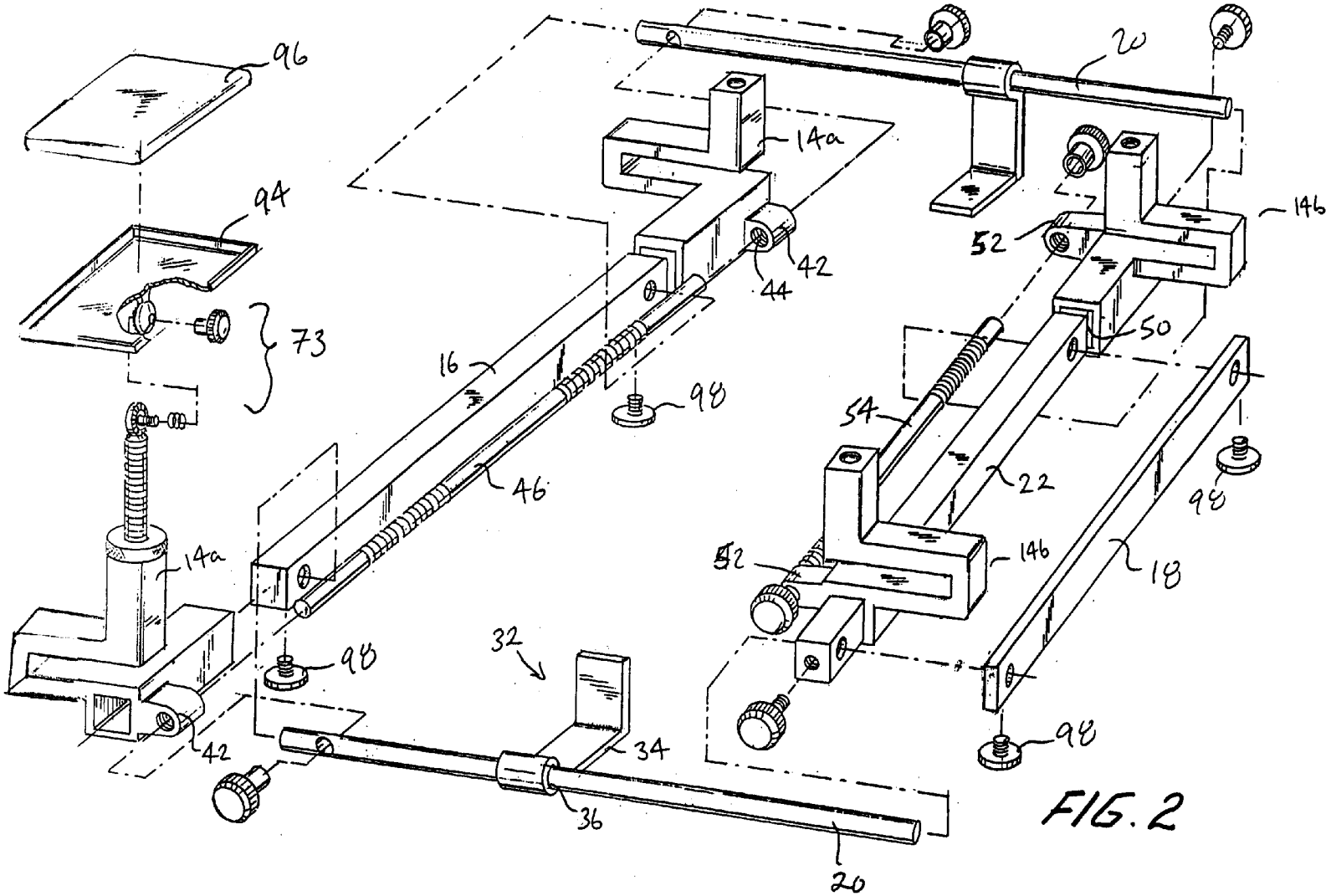
FIG. 2 is an assembly view of the patient support device of FIG. 1, according to the invention.
Figure 3:
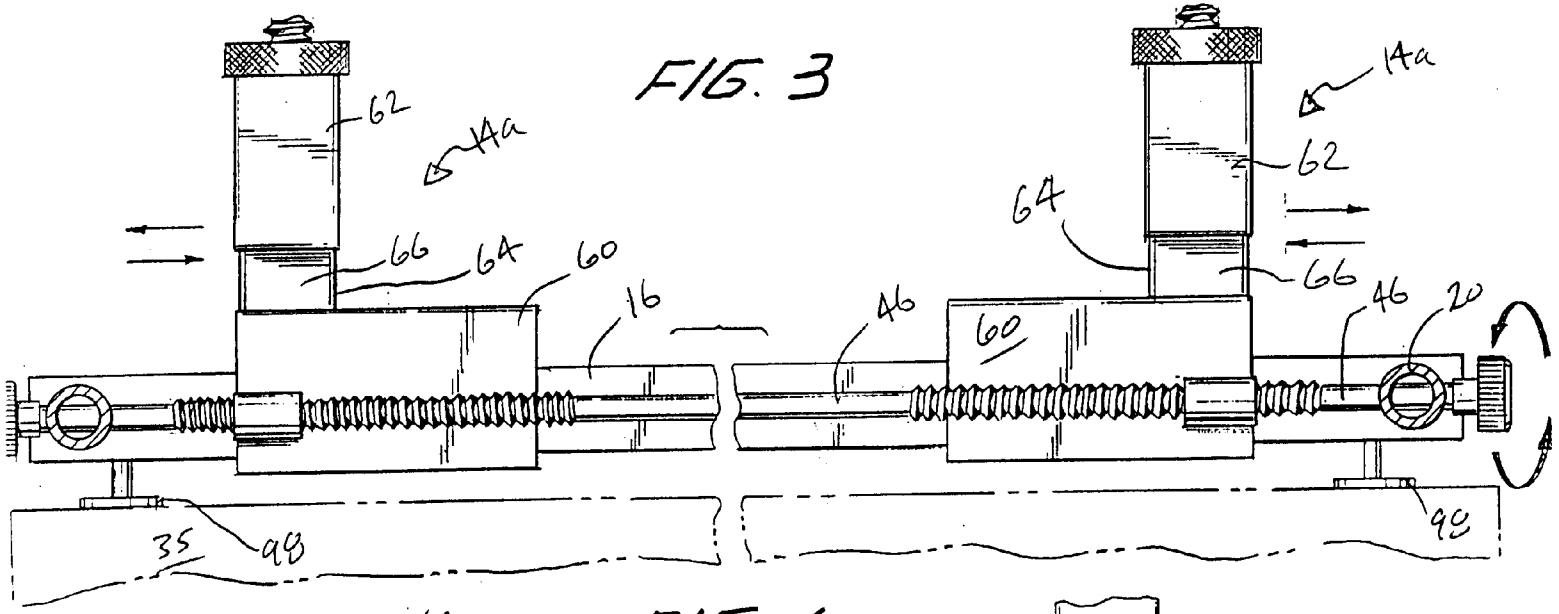
FIG. 3 is a sectional view taken along the lines 3—3 of FIG. 1, showing details of a front lead screw arrangement and front posts, according to the invention.

Referring to FIGS. 1 and 2, a patient supporting device 10 according to the invention is shown having a frame assembly 12, and four vertically disposed support posts 14 slidably attached to frame assembly 12. Frame assembly 12 is generally rectangular and comprises a front member 16, a rear member 18, and two side members 20. Front and rear members 16, 18 are parallel to each other, while side members are parallel to each other. Front member 16 and rear member 18 are preferably rectangular in section, while side members 20 are preferably circular in section.

It is preferred that the parts of frame assembly 12, including the front member 16, rear member 18, side members 20, and each post 14 be made from 304 stainless steel.

The term "front" is used throughout this application to indicate a direction towards the patient's head (cephalad), while the term "rear" indicates a direction towards the patent's feet (caudad). The term "longitudinal" is used to indicate a direction parallel to the patient's spine. The term "transverse" is used to indicate a direction that is across the operating table (from side to side).

A travelling member 22 is transversely positioned within frame assembly 12 and slidably mounted to side members 20. Travelling member 22 may slide longitudinally along side members 20 remaining parallel to both front and rear members 16, 18.

The present invention requires four support pads 24 which contact the patient at the above described points. Each pad 24 is pivotally attached to a post 14, described in detail below. Two front posts 14*a* are mounted to front member 16 and may slide therealong in a transverse direction across the operating table, as desired. Two rear posts 14*b*, are mounted to travelling member 22, and may similarly slide therealong, as desired.

Attached to each side member 20 of frame assembly 12 is a clamp assembly 32. Clamp assembly 32, shown in FIGS. 1 and 2, includes a clamping member 34 which includes a bore 36. Bore 36 is sized and shaped to receive a respective side member 20 so that clamp assembly 32 may be displaced longitudinally along its respective side member 20 and selectively rotated about side member 20. The purpose of clamp assemblies 32 is to firmly attach frame assembly 12 to an upper surface of an operating table 35 (shown in phantom in the Figures). Each clamp assembly 32 may be easily positioned along its respective side member 20 to an appropriate location and rotated so that clamping member 34 engages a side portion of operating table 35 (e.g., through a slot or channel located within the table, not shown) and thereby secures frame assembly 12 to operating table 35. Any appropriate clamping mechanism may be used in place of clamp assembly 32 including a screw clamp type which has a lead screw that may be tightened against a portion of operating table 35 to tightly pull frame assembly 12 against an upper surface of operating table 35.

All four posts 14 are similar in structure and function. Two front posts 14*a* are slidably mounted to front member 16, while the remaining two rear posts 14*b* are slidably mounted (in this embodiment) to travelling member 22. Due to similarities in front posts 14*a* and rear posts 14*b*, only front posts 14*a* are described in detail. Unless otherwise stated, the following description applies to both front and rear posts.

Front posts 14*a* are slidable side to side along front member 16. Each post 14 includes a bore 40 having a sectional shape similar to the section shape of front member 16. Bore 40 is adapted to receive front member 16 so that post 14 may slide along front member 16, but is restricted to an upright orientation, as shown in FIG. 1, so that each post 14 remains vertical with respect to operating table 35. Each post 14 also includes a boss 42 (preferably directed towards the center of frame assembly 12). Boss 42 has a threaded bore 44 that is adapted to engage with the threads of a front lead screw 46. Front lead screw 46 is rotatably mounted to side members 20 so that front lead screw is adjacent and parallel to front member 16 (preferably along an inner side of front member 16, as shown in FIG. 1). As front lead screw 46 is rotated, front posts 14 are forced to slide along front member 16. Front lead screw 46 preferably includes a center-tapped reverse-thread arrangement (i.e., left and right handed threads changing at the center of the lead screw and frame assembly 12). With this arrangement, rotation of front lead screw 46 evenly and simultaneously displaces each of front posts 14*a* a desired distance (depending on the number of lead-screw rotations and the pitch of the lead screw threads) from each other and in opposite directions along front member 16.

As discussed above, rear posts 14*b* are generally identical to front posts 14*a* except that rear posts 14*b* are slidably mounted to travelling member 22. Each rear post 14*b* includes a bore 50 adapted to receive travelling member 22 so that each rear post 14*b* may freely slide therealong. Rear posts 14*b* further include threaded bosses 52 that are adapted to engage the threads of a rear lead screw 54. Rear lead screw 54 is similar to front lead screw 46 in that rotation of rear lead screw 54 will force each rear post 14*b* to move equally, but in opposing directions. It is preferred that a center mark 55 and appropriate graduations 57 be positioned on both travelling member 22 and front member 16 so that an operator may easily determine the distance between two posts 14 along either front member 16 or travelling member 22.

Figure 6:
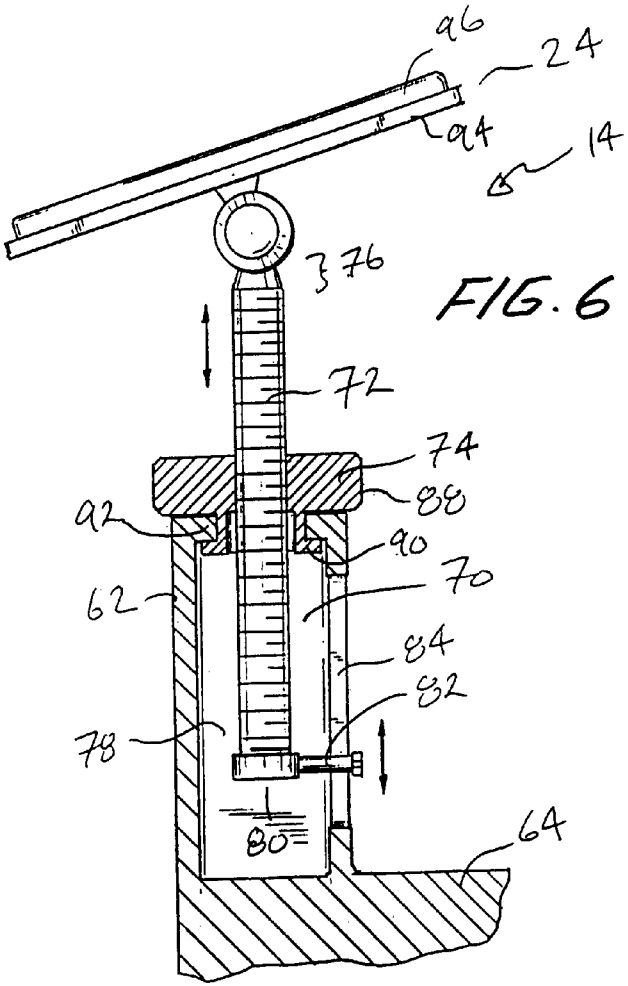
FIG. 6 is a sectional view, taken along the lines 6—6 of FIG. 5, showing details of a vertical displacement mechanism, according to the invention.
Figure 5:
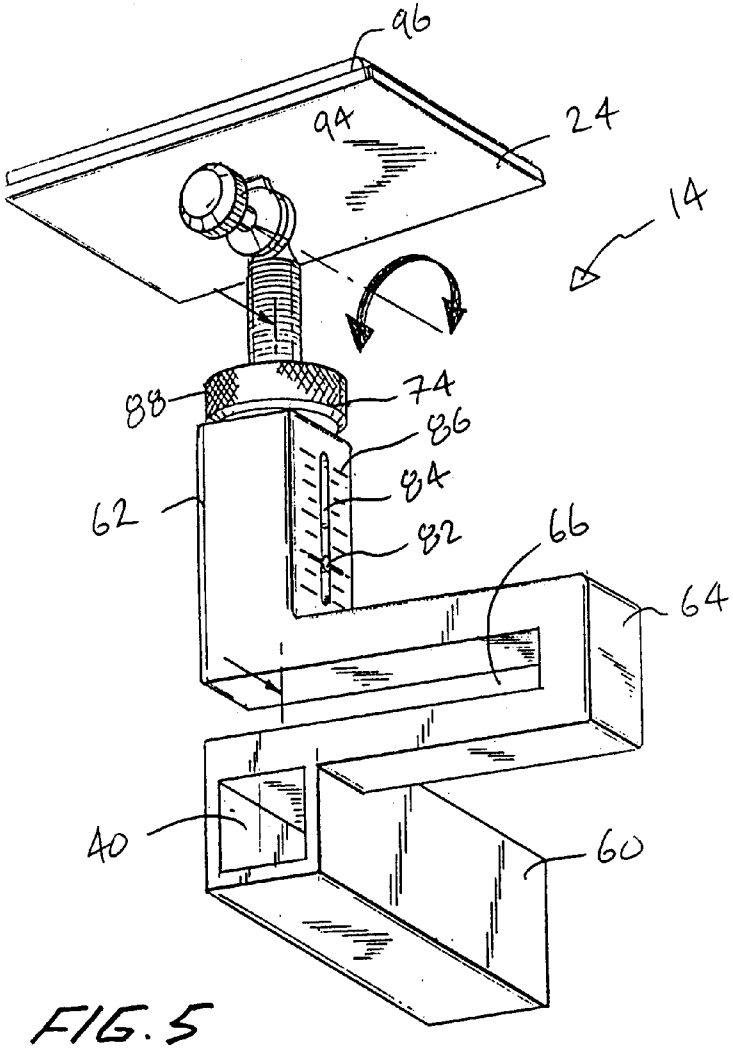
FIG. 5 is a perspective view of a post assembly, according to the invention.

Referring to FIGS. 5 and 6, post 14 is shown in perspective and partially in section. Each post 14 is substantially similar in construction and function and therefore only a representative post 14 is described in detail.

Figure 4:
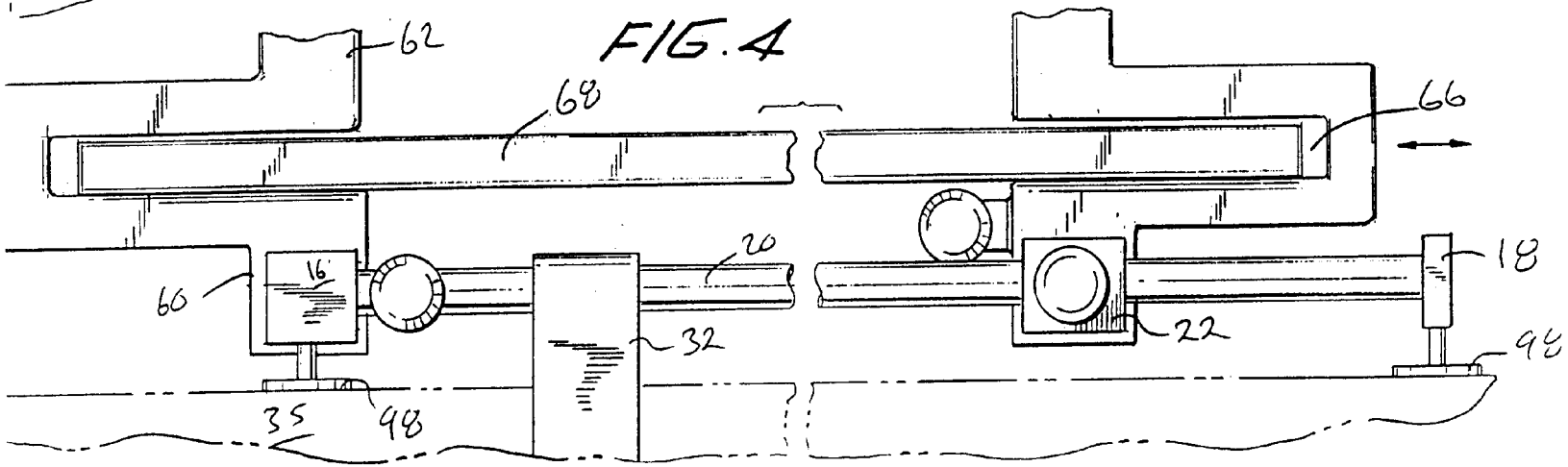
FIG. 4 is a side partial view of the patient support device of FIG. 1, showing details of a film cassette and holder, according to the invention.

Each post 14 includes a base 60, a tower 62 and an interconnecting U-shaped holder 64. In this preferred embodiment, base 60, tower 62 and holder 64 are all made from a strong metal, such as 304 stainless steel, and are formed separately and welded together or cast integrally as a single piece and milled (or otherwise machined) to form the post assembly. As discussed above, base 60 includes a bore 40 having a sectional shape that is similar to the sectional shape of the receiving member (either front member 16 or travel member 22). Holder 64 is U-shaped and defines a channel 66 that has a width (w) and a depth (d). The purpose of holder 64 is to receive and hold a film cassette 68 (shown in FIG. 4) used during X-ray radiography. The width and depth of channel 66 are appropriately sized to receive film cassette 68. All U-shaped channels of all four posts are directed outwardly, away from the center of frame assembly 12, as shown in FIG. 1.

Tower 62 includes a vertically disposed bore 70 into which a threaded rod 72 is located. An upper end 76 of rod 72 is connected to an underside of pad 24. The connection of rod 72 to pad 24 is preferably pivotal (as illustrated by the arcuate arrow in FIG. 5) so that pad 24 may pivot with respect to rod 72. Rod 72 is supported by tower 62 and is vertically adjustable through engagement of a threaded nut 74 (as illustrated by arrow in FIG. 6). Nut 74 is positioned adjacent to bore 70 above tower 62. Nut 74 engages rod 72 so that rotation of nut 74 forces vertical displacement of rod 72, and therefore pad 24, with respect to tower 62 and frame assembly 12.

A lower end 78 of rod 72 is located within bore 70 of tower 62. An indicator 80 is rotatably connected to lower end 78 of rod 72 and includes a horizontally disposed projection 82. Tower 62 includes a vertically disposed slot 84. Located adjacent to slot 84 are graduations 86 (or other suitable markings). Projection 82 protrudes through slot 84 and may be visually compared to adjacent graduations 86 to indicate, for example, the distance between pad 24 and operating table 35. Indicator 80 is preferably rigidly attached to rod 72 so that as nut 88 is rotated, rod 72 will be vertically displaced without causing rotation of either rod 72 or pad 24. Also, nut 74 preferably includes a knurled outer surface 88 so that an operator may easily rotate nut 74 using fingers. Nut 74 may include a downwardly directed and outwardly expanding flange 90 that may engage with an opposing inwardly directed flange 92 so that nut 74 may rotate with respect to tower 62, but may not be removed therefrom.

Pad 24 preferably includes a rigid mounting plate 94 and a cushion 96. Cushion 96 preferably includes a liquid, gel, or particle-filled (such as sand) section which may comfortably conform to a patient's body. Cushion 96 may alternatively include vinyl covered foam rubber. If foam rubber is used, it should be of a chemical composition, density, and thickness that allows it to conform to the patient's anatomy, with sufficient material remaining under points of maximum compression to allow proper cushioning. Each pad 24 is preferably fixed with respect to rod 72 and may not rotate.

Regardless of the materials chosen, cushions 96 must prevent cutaneous and neurological trauma to the patient. Also, it is preferred that cushions 96 be made from a radio-transparent material so that they do not create shadows on exposed radiographs.

In operation of the device, frame assembly 12 is first secured to operating table 35 using clamp assembly 34, as described above. Preliminary measurements of particular points of the patient are used to make some initial adjustments of posts 14. Front posts 14*a* are moved equally from centerline 55 an appropriate amount until front pads 24 are positioned according to preliminary measurements. Similarly, the two rear posts 14*b* are displaced along rear member 18, equidistant from centerline 55. If necessary, travelling member 22 which supports rear post 14*b* may be displaced along side members 20 to move rear posts 14*b* with respect to front posts 14*a*.

Frame assembly 12 allows each pad to be adjustable in left and right directions, as well as in cephalad (towards the head of the patient) and caudad (towards the feet) directions to accommodate a wide range of anatomies. Each pad is independently adjustable along a vertical (dorsal-ventral) direction to position and shape the patient's spine according to various surgical procedures and requirements.

A patient is then positioned onto frame assembly 12, contacting posts 14. Each post 14 is adjusted again so that two front posts 14*a* are respectively positioned approximately two inches below right and left axillary fossa, and two rear posts 14*b* are positioned at the right and left anterior superior iliao spine.

Once cushions 96 contact the patient, they conform to the contours of the local anatomy. Pads 24 may be raised or lowered, as described above, by rotating nut 74 in either direction. Each pad 24 may be pivoted with respect to rod 72 by loosening locking mechanism 73 located under each pad 24.

It is preferred that the width of frame assembly 12 (i.e., the length of each end member 16, 18) be approximately equal to the width of operating table 35, generally no greater than 20 inches wide. The length of frame assembly 12 (i.e., the length of side members 20) is preferably sufficient to accommodate the majority of patients.

Both front posts 14*a* and rear posts 14*b* should be adjustable between 6 inches and 16 inches from each other, respectively. Front posts 14*a* are preferably adjustable between 12 inches and 22 inches from rear posts 14*b*.

Each post 14 is preferably adjustable vertically at least 3 inches. Each post 14 should be made sufficiently strong to support 400 lbs.

The minimum distance between cushions 96 and operating table 35 is 11 inches.

The depth (d) of channel 66 of holder 64 is approximately 4 inches.

The width (w) of channel 66 of holder 64 is preferably sufficient to accommodate an X-ray cassette.

Frame assembly 12 preferably includes slip-resistant foot pads 98 located generally at the corners of rectangular frame assembly 12 to prevent frame assembly 12 from sliding on operating table 35 once the frame is clamped to the table.

Referring to FIG. 2, an assembly view of patient supporting device 10 is shown. Although front member 16, rear member 18 and side members 20 may be connected together using removable fasteners, such as nuts and bolts, it is preferred that these elements are connected together using a close-tolerance press fit connection (i.e., each side member 20 may be press-fit into a close-tolerance bore located in front and rear members). Each connection is thereafter silver-soldered so that the connections are sealed and free of minute crevices into which microbacteria may reside. The use of silver solder provides an effective barrier against contamination, yet may be easily melted away should the frame assembly require repair or modification.

It is also preferred that travelling member 22 include a locking screw 100 at each end which may be selectively tightened into engagement with each respective side member 20 to lock travelling member 22 in a particular position. Any linear movement translated through rotation of front lead screw 46, rear lead screw 54, or rod 72 does not require supplemental locking mechanisms since screw threads inherently prevent linear movement of their engaged element unless they are rotated. Front lead screw 46, rear lead screw 54, and rod 72 of each post 14 preferably includes a friction element (not shown) to resist their unintentional rotation.

Figure 7:
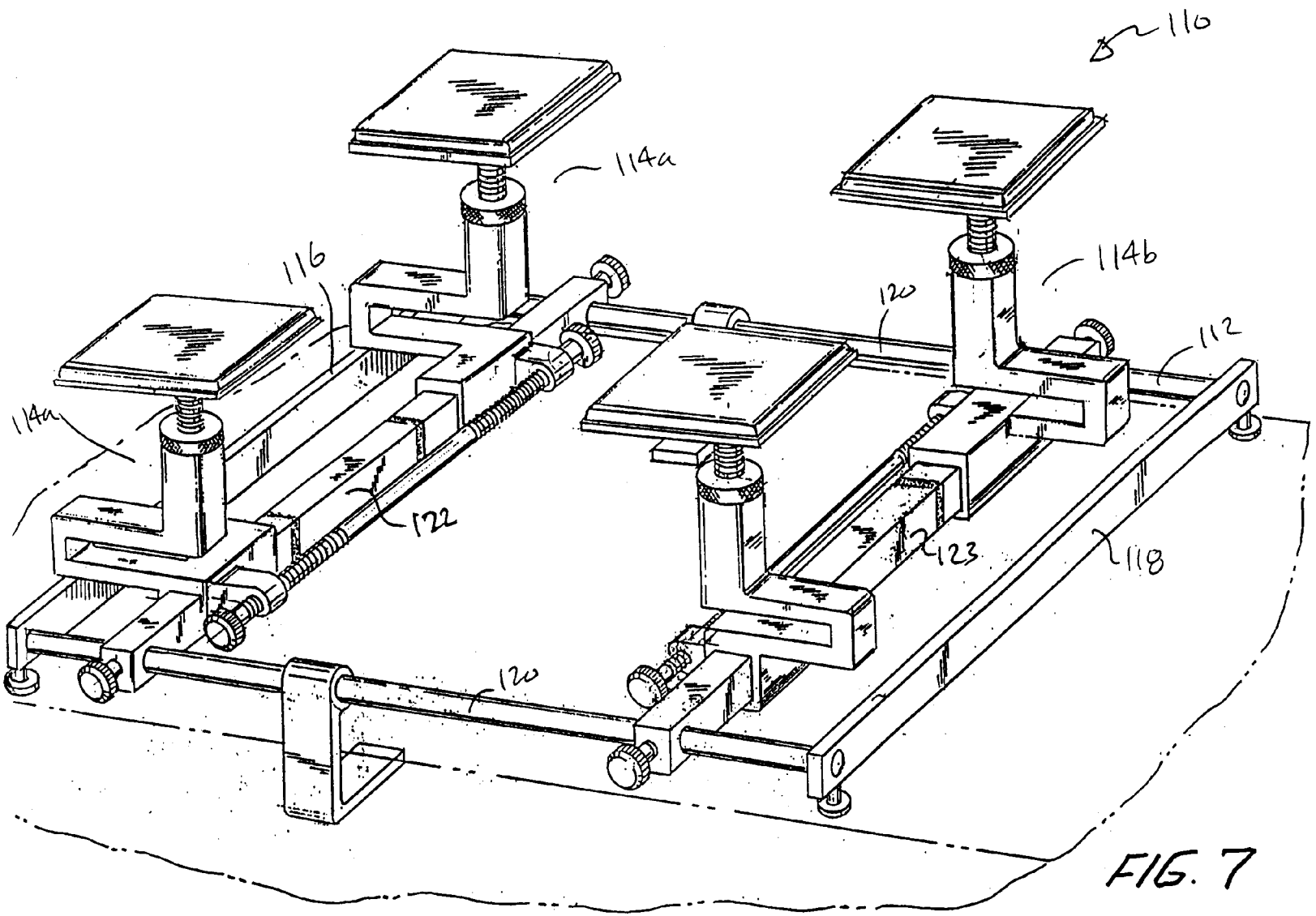
FIG. 7 is a perspective view of a patient support device, according to a second embodiment of the invention.

Referring to FIG. 7, a patient support device 110 according to a second embodiment of the invention is shown. The patient support device illustrated here and described below is similar to patient support device 10, described above and illustrated in FIGS. 1–6.

Patient support device 110 includes a generally rectangular frame assembly 112 having front member 116, rear member 118, and two opposing side members 120 all connected together end to end to form a rectangular planar frame 112. A front travelling member 122 and a rear travelling member 123 are slidably mounted to both side members 120 so that either or both travelling members 122, 123 may be independently displaced longitudinally, along side members 120. Travelling members 122, 123 remain parallel to each other and to front and rear members 116, 118. In this embodiment, front member 116 may be identical to rear member 118.

Front posts 114*a* are slidably mounted to front travelling member 116 and may be transversely displaced along front travelling member 116 in the same manner that rear posts 14*b* are displaced along travelling member 22 in the above-described embodiment, and therefore is not further discussed here. Similarly, rear travelling member 123, shown in FIG. 7, slidably supports two rear posts 114*b* which may be selectively displaced transversely therealong in the same manner as rear posts 14*b* are displaced along travelling member 22, described above in the first embodiment of the invention.

What is claimed is:

1. A support for a patient adapted to be mounted to an operating table, said support comprising:

a generally rectangular frame having two opposing end members and two opposing side members;

a first pair of posts slidably mounted to one of said two opposing end members, said posts slidable along said one end member between said two opposing side members;

a travelling member slidably mounted to both of said two opposing side members, said travelling member being slidably along said side members between said two opposing end members;

a second pair of posts slidably mounted to said travelling member, said second pair of posts slidably along said travelling member between said two opposing side members; and means for simultaneous displacing said posts of said first pair of posts along said one end member, said displacing means simultaneously moving said posts in opposing directions along said one end member;

wherein said first and second pairs of posts adapted to contact and support said patient above said operating table.

2. The patient support device according to claim 1, further comprising means for simultaneous displacing said posts of said second pair of posts along said travelling member, said displacing means simultaneously moving said posts in opposing directions along said travelling member.

3. The patient support device according to claim 1, wherein said displacing means includes a lead screw having a central point and two ends, said lead screw including forward threads between said central point and one end, and reverse threads between said central point and the opposing end, one of said front posts is engaged with said forward threads and the other of said front posts is engaged with said reverse threads so that rotation of said lead screw forces each post to move in opposite directions along said lead screw and said end member.

4. The patient support device according to claim 1, wherein each post further comprises a cushion adapted to conform to a patient's body.

5. The patient support device according to claim 4, further comprising means for vertically displacing said cushion with respect to said post.

* * * * *